US005553337A

United States Patent [19]

Lin

[11] Patent Number: 5,553,337

[45] Date of Patent: Sep. 10, 1996

[54] ELECTRIC CRADLE

[76] Inventor: Chien-Tao Lin, P.O. Box 2103, Taichung City, Taiwan

[21] Appl. No.: 538,008

[22] Filed: Oct. 2, 1995

[51] Int. Cl.[6] ..... A47D 7/00; A47D 9/00

[52] U.S. Cl. ..... 5/93.2; 5/100; 5/109; 5/129

[58] Field of Search ..... 5/109, 108, 101, 5/93.1, 93.2, 100, 127, 129

[56] References Cited

U.S. PATENT DOCUMENTS

| | | | |
|---|---|---|---|
| 1,505,117 | 8/1924 | Withun | 5/109 |
| 2,071,016 | 2/1937 | Archer | 5/129 |
| 2,853,719 | 9/1958 | Levin | 5/100 |
| 3,821,822 | 7/1974 | Borreggine | 5/93.2 |
| 4,549,322 | 10/1985 | De Boeve | 5/93.2 |

FOREIGN PATENT DOCUMENTS

| | | | |
|---|---|---|---|
| 960803 | 1/1975 | Canada | 5/109 |
| 3530527 | 9/1987 | Germany | 5/109 |

*Primary Examiner*—Flemming Saether

[57] ABSTRACT

An electric cradle including a crib, a main support disposed under the crib to support the crib and two swinging frames pivotally connecting the main support with two ends of the crib. A swinging mechanism is used to swing the swinging frames so as to swingingly drive the crib to form an electric cradle. The two swinging frames can be alternatively removed from the crib and the length of the main support can be adjusted in order to permit direct securing of the two ends of the crib to the main support. In addition, the height of the side fences of the cribs can be adjusted to meet the standing height of an infant, whereby the electric cradle can be transformed into a fixed crib.

4 Claims, 3 Drawing Sheets

ELECTRIC CRADLE

BACKGROUND OF THE INVENTION

The present invention relates to an electric cradle which can be transformed into a fixed crib for a grown infant.

A conventional electric cradle provides a sleeping environment for an infant. When the infant grows up, the electric cradle will be no more suitable for the infant and a larger crib is necessary. Under such circumstance, because the electric cradle can be hardly effectively fixed and is still subject to swinging movement, the electric cradle cannot serve as a fixed crib for the infant. Moreover, the conventional electric cradle is not collapsible and always occupies considerably large room for storage.

SUMMARY OF THE INVENTION

It is therefore a primary object of the present invention to provide an electric cradle which can be transformed into a large fixed crib for a grown infant. Therefore, the expense for purchasing another crib is saved.

The present invention can be best understood through the following description and accompanying drawing, wherein:

DETAILED DESCRIPTION OF THE PREFERRED EMBODIMENTS

Figure 1:
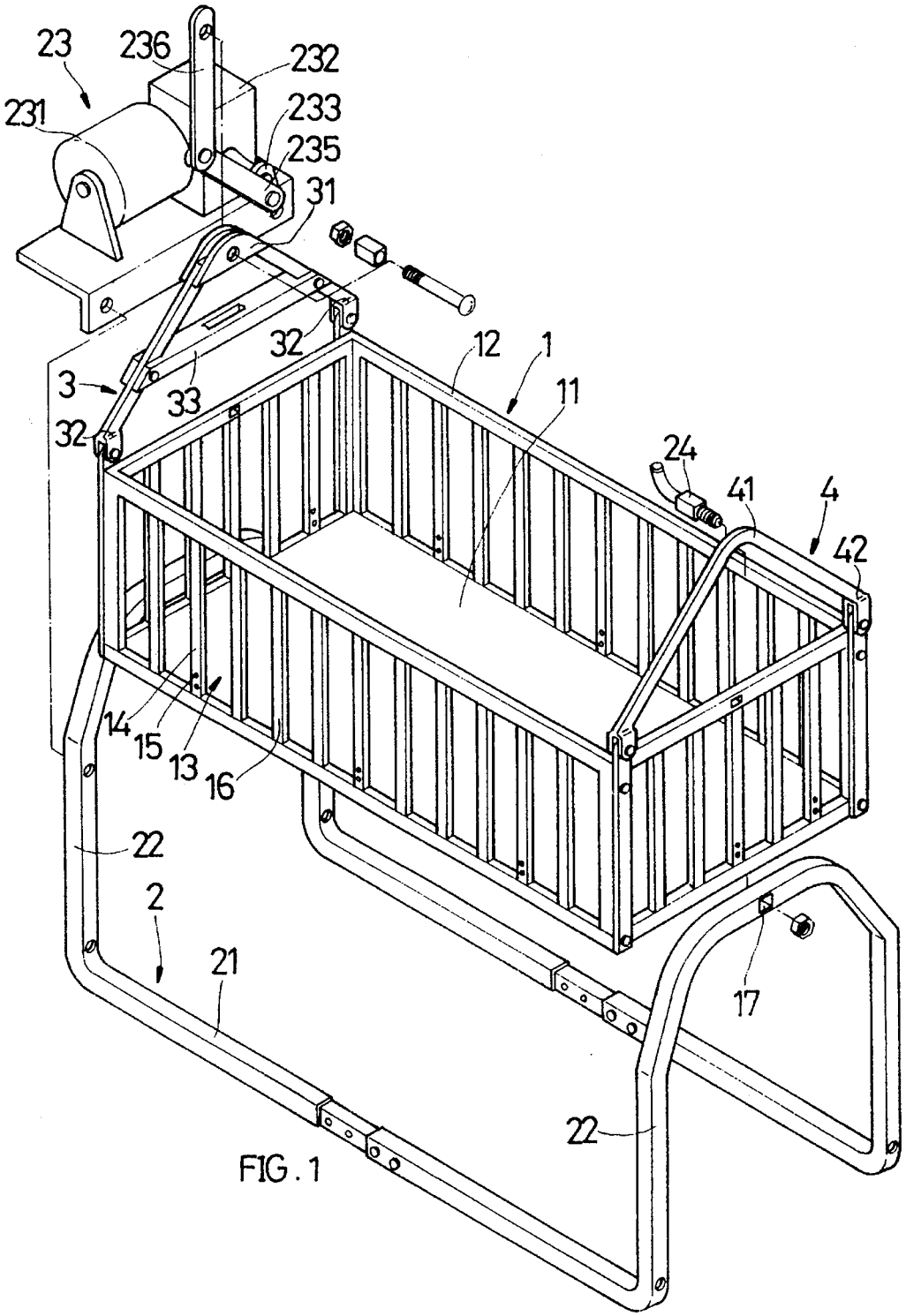
FIG. 1 is a perspective exploded view of a preferred embodiment of the present invention.

Please refer to FIG. 1. The electric cradle of the present invention includes a crib 1, a main support 2, a first swinging frame 3 and a second swinging frame 4.

The crib 1 includes a rectangular bottom board 11 and four side fences 12 upward extending from a periphery of the bottom board 11 to define a sleeping room for an infant. Each side fence 12 consists of a plurality of extensible members 13 including multiple fixably extensible members 14 and multiple unfixably extensible members 16 which are interlaced with each other. Each fixably extensible member 14 can be secured at a certain height by a fixing means 15.

The main support 2 includes a base seat 21 horizontally placed on the ground and two supporting stands 22 which are upward bent and extended from two ends of the base seat 21. The supporting stands 22 are connected to two opposite ends of the crib 1 with the base seat 21 positioned under the crib 1. The base seat 21 is fixably extensible for adjusting a distance between the two supporting stands 22.

The first swinging frame 3 has an upper end 31 coupled with one of the supporting stands 22 and a forked lower end 32 pivotally connected to one end of the crib 1. A swinging mechanism 23 is disposed on the supporting stand 22 of the main support 2 to drivingly regularly swing the first swinging frame 3. In turn, the lower end 32 of the first swinging frame 3 drives the crib 1 to swing accordingly. The swinging mechanism 23 includes a motor 231 which outputs power to a reducing device 232 for rotarily driving an eccentrical cam 233. The cam 233 in turn linearly reciprocates a driving lever 235 disposed at an eccentrical end of the cam 233. One end of the driving lever 235 in turn swingingly drives a driven lever 236 a top end of which is pivotally coupled with the supporting stand 22. A middle section of the driven lever 236 thus swings and pushes a stopper section 33 of the first swinging frame 3, making the same swing left and right.

The second swinging frame 4 is coupled with the other supporting stand 22 of the main support 2. A hanging section 24 is disposed at a top end of the supporting stand 22 for hanging an upper end 41 of the second swinging frame 4 thereon. A similar forked lower end 42 of the second swinging frame 4 is pivotally connected to the other end of the crib 1, making the second swinging frame 4 swing along with the crib 1.

Figure 2:
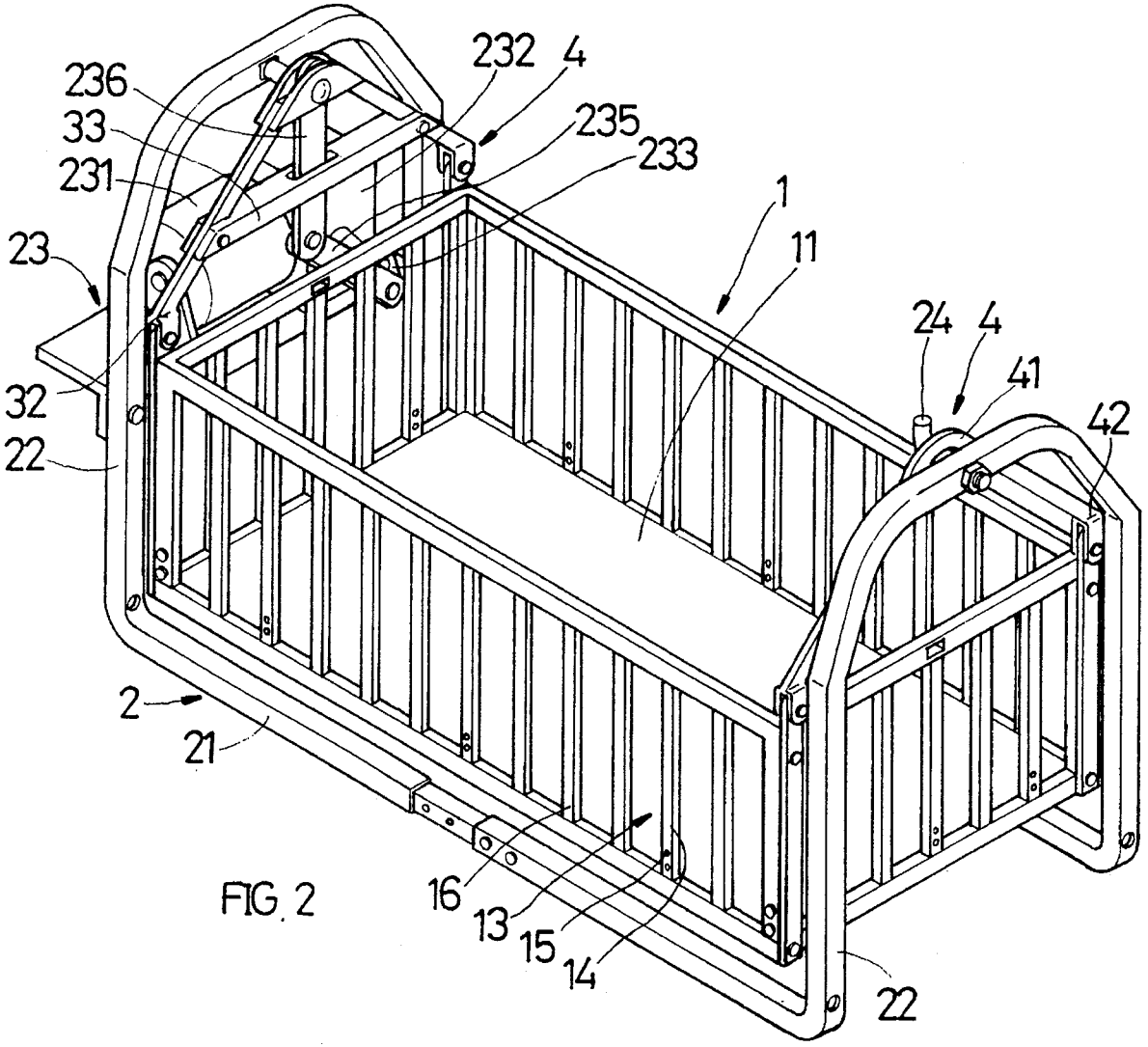
FIG. 2 is a perspective assembled view of the embodiment of FIG. 1.

Please refer to FIG. 2. The swinging mechanism 23 disposed on the supporting stand 22 swingingly drives one end of the crib 1, while the other end of the crib 1 hung on the hanging section 24 is driven and swung along with the crib 1.

Figure 3:
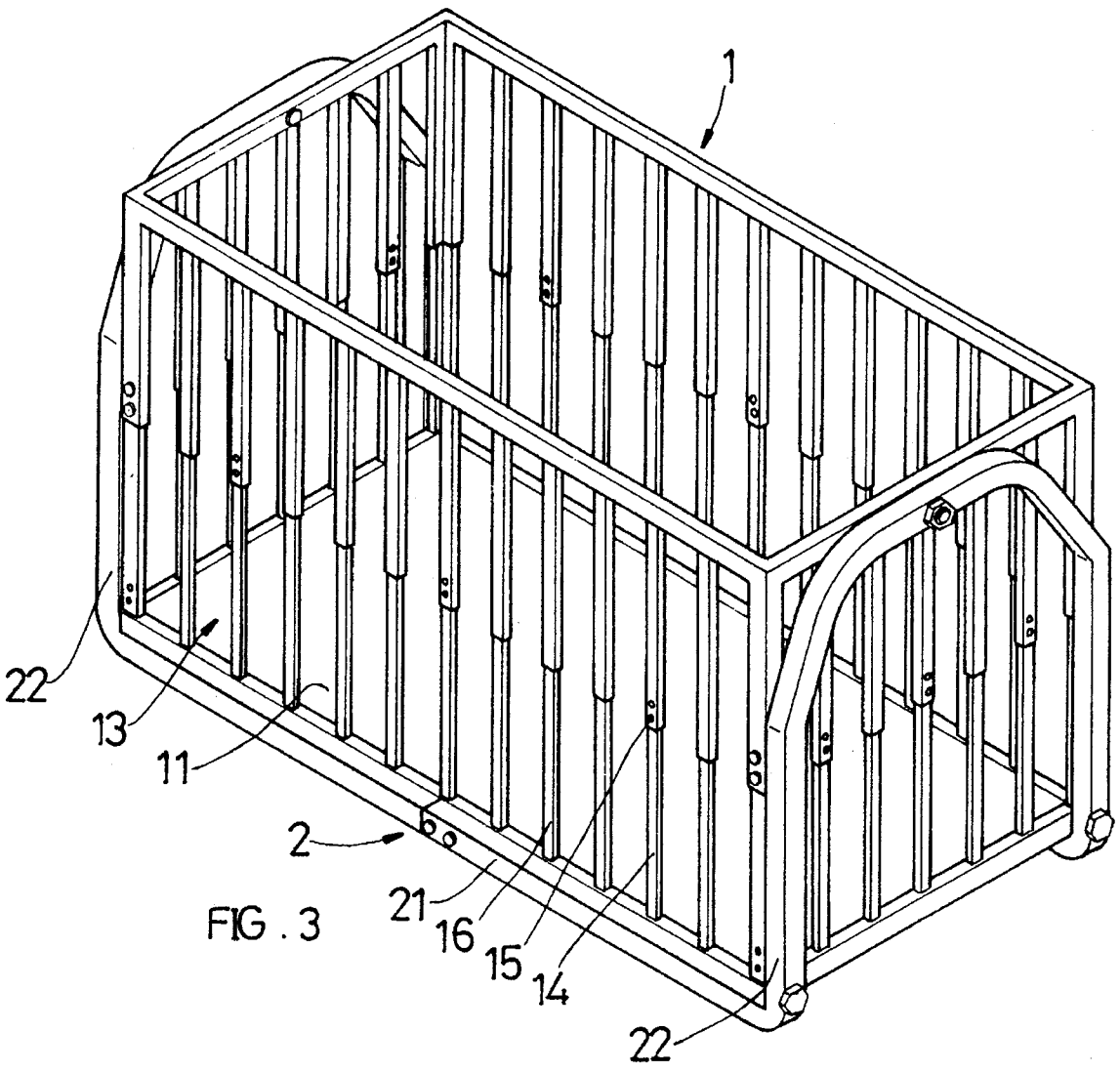
FIG. 3 is a perspective assembled view of a fixed crib transformed from the embodiment of FIG. 1.

Please refer to FIG. 3. The first and second swinging frames 3, 4 can be separated from the supporting stands 22 and the crib 1. In addition, the base seat 21 of the main support 2 can be extended or contracted to adjust the distance between the supporting stands 22. Therefore, after removing the first and second swinging frames 3, 4, two ends of the crib 1 can be directly secured to the supporting stands 22 to form a fixed crib. Moreover, the height of the extensible members 14, 16 of the side fences 12 can be adjusted to such a height that the infant is protected from falling down from the crib 1.

The crib 1 and the supporting stands 22 are formed with rectangular fastening holes 17 for securing the crib 1 to the supporting stands 22. Therefore, the crib 1 is prevented from turning over relative to the supporting stands 22 due to unstable gravity center of the infant.

When serving as an electric cradle, the crib 1 of the present invention preferably is positioned as close to the ground as possible so as to lower the gravity center and stabilize the swinging movement. However, when serving as a fixed crib, in order to meet the standing height of the infant resting against the side fences 12 of the crib 1, the side fences 12 are extended and raised in order to protect the infant from falling out of the crib 1.

In addition, after the first and second swinging frames 3, 4 are removed, the base seat 21 of the main support 2 must be shortened to offset the thickness of the first and second swinging frames 3, 4 and permit direct securing of the supporting stands 22 to the crib 1 by screws.

It is to be understood that the above description and drawings are only used for illustrating one embodiment of the present invention, not intended to limit the scope thereof. Any variation and derivation from the above description and drawings should be included in the scope of the present invention.

What is claimed is:

1. An electric cradle comprising:

a crib including a bottom board and side fences upward extending from a periphery of said bottom board, each side fence including a plurality of extensible members;

a main support including a base seat horizontally placed on the ground and two supporting stands which are upward bent and extended from two ends of the base seat, said supporting stands being connected to two opposite ends of said crib with said base seat positioned under said crib, said base seat being extensible for adjusting a distance between said supporting stands;

a first swinging frame having an upper end coupled with one of said supporting stands and a forked lower end pivotally connected to one end of said crib, a swinging mechanism being disposed on said supporting stand of said main support to drivingly regularly swing said first swinging frame, making said lower end of said first swinging frame swingingly drive said crib; and a second swinging frame coupled with the other supporting stand of said main support, a hanging section being disposed at a top end of said other supporting stand for hanging an upper end of said second swinging frame thereon, a forked lower end of said second swinging frame being pivotally connected to the other end of said crib, making said second swinging frame swing along with said crib, said first and second swinging frames being separable from said supporting stands and said crib and said base seat of said main support being extensible/contractable for adjusting the distance between said supporting stands and permitting direct securing thereof to two ends of said crib, said side fences being adjustable in height for meeting a standing height of an infant, whereby said electric cradle is transformed into a fixed crib for the infant.

2. An electric cradle as claimed in claim 1, wherein each of said side fences includes multiple fixably extensible members and multiple unfixably extensible members which are interlaced with each other, each of said fixably extensible members being fixable at a certain height by a fixing means.

3. An electric cradle as claimed in claim 1, wherein said swinging mechanism includes a motor which outputs power to a reducing device for rotarily driving an eccentrical cam, said cam in turn linearly reciprocating a driving lever disposed at an eccentrical end of said cam, one end of said driving lever in turn swingingly driving a driven lever, a middle section of said driven lever being pivotally coupled with said supporting stand for pushing a stopper section of said first swinging frame, making the same swing left and right.

4. An electric cradle as claimed in claim 1, wherein said crib and said supporting stands are formed with rectangular fastening holes for securing said crib to said supporting stands and preventing said crib from rotating relative to said supporting stands.

* * * * *